US012584078B2

(12) United States Patent
Erkel et al.

(10) Patent No.: US 12,584,078 B2
(45) Date of Patent: Mar. 24, 2026

(54) METHOD FOR PRODUCING LUBRICATING GREASES OF LITHIUM COMPLEX SOAPS AND LITHIUM-CALCIUM-COMPLEX SOAPS

(71) Applicant: FUCHS SE, Mannheim (DE)

(72) Inventors: Hans Jürgen Erkel, Bruchmühlbach-Miesau (DE); Olaf Binkle, Kirkel (DE); Torsten Goerz, Hochspeyer (DE)

(73) Assignee: FUCHS SE, Mannheim (DE)

( * ) Notice: Subject to any disclaimer, the term of this patent is extended or adjusted under 35 U.S.C. 154(b) by 0 days.

(21) Appl. No.: 18/719,800

(22) PCT Filed: Nov. 7, 2022

(86) PCT No.: PCT/DE2022/100822

§ 371 (c)(1),
(2) Date: Jun. 13, 2024

(87) PCT Pub. No.: WO2023/110001

PCT Pub. Date: Jun. 22, 2023

(65) Prior Publication Data

US 2025/0043210 A1 Feb. 6, 2025

(30) Foreign Application Priority Data

Dec. 16, 2021 (DE) ..... 102021133469.1

(51) Int. Cl.

| | |
|---|---|
| ***C10M 169/02*** | (2006.01) |
| ***C10M 117/04*** | (2006.01) |
| ***C10M 117/06*** | (2006.01) |
| ***C10M 117/10*** | (2006.01) |
| ***C10M 177/00*** | (2006.01) |
| *C10N 20/02* | (2006.01) |
| *C10N 40/02* | (2006.01) |
| *C10N 50/10* | (2006.01) |
| *C10N 70/00* | (2006.01) |

(52) U.S. Cl.

CPC ..... *C10M 169/02* (2013.01); *C10M 117/04* (2013.01); *C10M 117/06* (2013.01); *C10M 117/10* (2013.01); *C10M 177/00* (2013.01); *C10M 2203/003* (2013.01); *C10M 2207/1276* (2013.01); *C10M 2207/1285* (2013.01); *C10M 2207/1426* (2013.01); *C10N 2020/02* (2013.01); *C10N 2040/02* (2013.01); *C10N 2050/10* (2013.01); *C10N 2070/00* (2013.01)

(58) Field of Classification Search

CPC ..... C10M 169/02; C10M 117/04; C10M 117/06; C10M 117/10; C10M 177/00; C10M 2203/003; C10M 2207/1276; C10M 2207/1285; C10M 2207/1426; C10N 2020/02; C10N 2040/02; C10N 2050/10; C10N 2070/00

See application file for complete search history.

(56) References Cited

U.S. PATENT DOCUMENTS

| | | | |
|---|---|---|---|
| 2,898,296 | A | 8/1959 | Pattenden et al. |
| 2,940,930 | A | 6/1960 | Pattenden et al. |
| 3,791,973 | A | 2/1974 | Gilani et al. |
| 4,444,669 | A | 4/1984 | Wittse et al. |
| 4,582,619 | A | 4/1986 | Carley et al. |
| 6,172,013 | B1 | 1/2001 | Holt et al. |
| 8,507,421 | B2 | 8/2013 | Zaki |
| 2010/0197535 | A1 | 8/2010 | Brossaud et al. |
| 2019/0300813 | A1 | 10/2019 | Shishikura |

FOREIGN PATENT DOCUMENTS

| | | | | |
|---|---|---|---|---|
| EP | 2361296 | B1 * | 9/2019 | ..... C10M 117/00 |
| JP | H11-302682 | A | 11/1999 | |
| WO | 2011095155 | A1 | 8/2011 | |
| WO | 2016123067 | A1 | 8/2016 | |

* cited by examiner

*Primary Examiner* — Taiwo Oladapo

(74) *Attorney, Agent, or Firm* — D'Ambrosio & Menon, PLLC; Usha Menon

(57) ABSTRACT

The object of the invention is a method for the production of lithium complex soap lubricating greases or lithium-calcium complex soap lubricating greases and corresponding lubricating greases produced by this process and their use in slide and rolling bearings.

19 Claims, No Drawings

METHOD FOR PRODUCING LUBRICATING GREASES OF LITHIUM COMPLEX SOAPS AND LITHIUM-CALCIUM-COMPLEX SOAPS

The invention relates to a method for the production of lithium complex soap lubricating greases or lithium-calcium complex soap lubricating greases and corresponding lubricating greases produced by this method and their use.

INTRODUCTION AND STATE OF THE ART

Lithium soaps have long been known as thickeners in lubricating greases. An organic acid saponified with lithium hydroxide, usually a fatty acid, is used as a thickener in a base oil. For example, the use of 12-hydroxystearic acid is common, whereby lithium 12-hydroxystearate is used as a thickener. Greases based on lithium soaps are called (simple) lithium soap lubricating greases.

In contrast, the production of lithium complex soap lubricating greases is based on a thickener that can be produced from the reaction of lithium hydroxide with a fatty acid and a complexing agent. Here too, a long-chain hydroxy fatty acid is often the fatty acid of choice, while the complexing agent is a shorter-chain dicarboxylic acid. Lubricating greases based on lithium complex soaps as thickeners are characterised by high dropping points, good water resistance and wide operating temperature ranges.

The notion here is that the joint, interacting amalgamation of both soaps, i.e. the lithium salt of the hydroxy fatty acid and the dicarboxylic acid, creates a soap mixture, stabilised via hydrogen bonds. The often short-chain dicarboxylic acids or dicarboxylic acid salts can create binding forces between the mostly long-chain fatty acid soap molecules as "bridging agents". This leads to an increase in the dropping point above the usual level of a "simple" lithium soap (e.g. maximally up to 190° C.-210° C.) because additional binding forces have to be overcome during melting. Lithium complex soap lubricating greases can be characterised by dropping points significantly higher than 250° C. The raw materials frequently used are 12-hydroxystearic acid, lithium hydroxide or a solution/slurry of lithium hydroxide and aliphatic dicarboxylic acids such as adipic acid (C6), azelaic acid (C8), sebacic acid (C10) or boric acid.

Lithium complex soap lubricating greases are thus typically produced by joint saponification of at least one long-chain hydroxy fatty acid and at least one dicarboxylic acid under heat in the presence of a base oil or base oil mixture. Suitable base oils are, for example, paraffinic or naphthenic mineral oils or mixtures thereof (Group 1 oils), synthetic oils such as polyalphaolefins, polyalkylene glycols or Group II oils, including mixtures thereof. Silicone oils can also be used as base oils.

The production of lithium complex soaps in ester-based base oils is not possible directly, as the formation of undesirable reaction products competes with the saponification reaction. The lithium soap can also be formed indirectly via saponification of a dicarboxylic acid ester, which in turn can be formed as an intermediate between dicarboxylic acid and alcohol (including polyhydric alcohols). The use of ready-made soaps to bypass the (partial) hydrolysis of esters used is difficult for the formation of the complex soap structure.

In the prior art manufacturing processes, saponification usually takes place in the base oil. US 2898296 discloses the production of a lithium complex soap lubricating grease starting from a fatty acid and a dicarboxylic acid soap, which are boiled together in a base oil together with $LiOH*H_2O$ (monohydrate).

US 2940930 A describes the production of a lithium complex soap lubricating grease in a batch process, whereby in a first step a polyhydric alcohol such as ethylene glycol is added to a mixture of mono- and dicarboxylic acid in a base oil and this mixture is saponified together with lithium hydroxide in a subsequent step.

US 4444669 A clearly stipulates that the manufacturing process can have a major influence on the level of the achievable dropping point. The lithium complex soap lubricating grease is produced by adding a carboxylic acid, dicarboxylic acid and aqueous LiOH solution to the base oil in a continuously operating reactor. For saponification, the temperature is gradually increased to 176° C., the water formed from the saponification reaction is kept in the system by pressurisation and subsequently removed in a controlled manner. A small amount of water can be introduced into the reaction zone.

US 3791973 A describes the production of a lithium complex soap lubricating grease with dropping points above 260° C. from the successive reaction of first a hydroxy fatty acid in the base oil with a concentrated aqueous lithium hydroxide solution in the heat and then, after cooling and addition of the aliphatic dicarboxylic acid, with a concentrated aqueous lithium hydroxide solution and repeated heating. The temperature regime and the reaction rate of the aliphatic dicarboxylic acid with the base are important here. This produces a mixed soap in which lithium monocarboxylate is linked by the di-lithium dicarboxylates.

EP 2361296 B1 describes the production of a mixed complex grease based on a lithium soap based on a hydroxy fatty acid with the complexing calcium or magnesium soaps based on a dicarboxylic acid via an autoclaving process. The thickening raw materials are brought together in a base oil with a small amount of water to start the reaction. It is worth mentioning that the dropping point of mineral oil-based greases is around 220° C. and that higher dropping points of over 260° C. can be achieved when using polyalkylene glycol base oils.

If very non-polar base oils such as polyalphaolefins are used, it is difficult to achieve high dropping points above 250° C. for lithium complex soap lubricating greases. This can be explained by the fact that there is no real complex soap in the form of a soap thickener bond formed from both carboxylic acids. Rather, a mixture of the two lithium soaps, fatty acids, and dicarboxylic acids, is present separately, which do not interact and are not combined to form a mixed soap structure. The additional interactions that occur in genuine lithium complex soaps, such as hydrogen bonds, between the two types of lithium soaps are absent or only present to a small extent. As a result, the dropping point is at a comparatively low level. Dropping point improvers must be used to increase the dropping point. Dropping point improvers suitable for lithium complex soap lubricating greases are often based on alkyl borate esters; their use is described, for example, in WO 2016/123067 A1.

US 2010/0197535 A1 discloses a process for producing a soap concentrate such as a lithium soap, lithium complex soap, lithium-calcium soap, or calcium complex soap in a reaction extruder, wherein an oil, such as hydrogenated castor oil, and the metal hydroxide or 12-hydroxystearic acid, optionally as a component of the oil, and the metal hydroxide are fed in a first zone and complexing agents are fed in a further zone. The first zone may be followed by a water injection zone, then the reaction zone, a deaeration zone and a cooling zone.

A process for producing a lubricating grease is known from JP H11-302682 A, according to which, as part of the process, an aqueous solution of lithium hydroxide monohydrate and an aliphatic dicarboxylic acid are reacted with a mixture of base oil and fatty acid or hydroxy fatty acid, which is homogeneous in the heat, and optionally a further amount of aliphatic dicarboxylic acid. The reaction with the dissolved monocarboxylic acid only starts in the presence of the base oil and the dispersing agent. Lithium hydroxide and dicarboxylic acid are present in parallel in water, but a saponification reaction is not brought about. The hydroxy fatty acid is not added to the already formed dicarboxylic acid soap.

What all the production processes described above have in common is that the saponification is carried out in the base oil, which is usually oleophilic.

Production methods have also been described for the formation of a soap structure in the case of mixed soaps, which contains both lithium soaps and alkaline earth soaps as complex soaps.

OBJECT OF THE INVENTION

The object of the invention is to provide a method for the production of lithium complex soap lubricating greases or lithium-calcium complex soap lubricating greases which permits a simple and energy-efficient process control and safe handling of the raw materials used. High dropping points should also be achieved and other raw materials should be usable compared to conventional processes, especially with regard to the dicarboxylic acids that can be used.

SUMMARY OF THE INVENTION

The present invention relates to a process for the production of lithium complex soap lubricating greases or lithium-calcium complex soap lubricating greases according to claim 1 and differs from known processes in that the dicarboxylic acid is first saponified with lithium hydroxide and/or with calcium hydroxide in substance as a solid in aqueous form. After saponification with the hydroxy fatty acid, complex soap lubricating greases are obtained in each case.

Preferred embodiments are the subject of the subclaims or are shown below.

The method for producing lithium complex soap lubricating greases or lithium-calcium complex soap lubricating grease comprises at least the following steps:

saponification of one or more dicarboxylic acids with one or two metal hydroxides as a solid, preferably in powder form, according to one of the following three alternatives:

(A1) saponification with lithium hydroxide, preferably in powder form, and one or more dicarboxylic acids, or (A2) saponification with lithium hydroxide and calcium hydroxide, preferably in powder form, and one or more dicarboxylic acids, or (A3) saponification with calcium hydroxide, preferably in powder form, and one or more dicarboxylic acids, each in an aqueous environment comprising more than 80 wt. % of water with respect to all liquid feedstocks (i.e. feedstocks which are liquid at 25° C.) to obtain one or more metal salts of the dicarboxylic acids, wherein both dicarboxyl groups of the dicarboxylic acids are substantially completely saponified;

bringing into contact with one or more liquid hydroxy fatty acids or hydroxy fatty acids liquefied by heating and dissolving the metal salt(s) in the liquid hydroxy fatty acid;

bringing into contact with base oil;

addition of further metal hydroxides, wherein according to alternative:

(A1) Lithium hydroxide or calcium hydroxide;

(A2) Lithium hydroxide and calcium hydroxide or lithium hydroxide only or calcium hydroxide only; or (A3) Lithium hydroxide is added;

for saponification with at least one hydroxy fatty acid;

expulsion of water under heating;

heating to a final temperature; and cooling down and addition more base oil.

The procedure is preferably carried out in the order described above.

Preferred embodiments are the subject of the subclaims or are described below.

The aqueous environment is characterised by a liquid phase which, in relation to the substances used which are liquid at 25° C. (=100 wt. %), comprises more than 80 wt. %, in particular more than 90 wt. % water and preferably consists of 100 wt. % water. If the dicarboxylic acid used is liquid at 25° C., it does not count as a liquid substance within the meaning of this definition.

According to one embodiment of the invention, a dicarboxylic acid is provided in water or in the aqueous environment, heated (e.g. to 60° C.) and then mixed with metal hydroxide (e.g. lithium hydroxide), preferably in powder form, to saponify the dicarboxylic acid as completely as possible, if necessary also slightly over-stoichiometrically.

However, the stoichiometric excess should be limited and, in particular, the excess should be small, e.g.

a) is selected so that the excess is less than 10 mol %, preferably less than 5 mol %, in relation to the hydroxy fatty acid used below, or b) alternatively, the excess should be less than 10 mol % relative to the reaction of dicarboxylic acid with the metal hydroxide (e.g. lithium hydroxide).

Preferably, the reaction is carried out with approximately the molar amount of metal hydroxide (e.g. lithium hydroxide) in relation to the dicarboxylic acid. The metal hydroxides are used to saponify one or more dicarboxylic acids in substance as a solid, preferably in powder form. This means that they are not dissolved in another solvent beforehand but in the "aqueous environment". The addition of the base in powder form has advantages in terms of occupational safety: The use of hot metal hydroxide lye is avoided. Saponification is completed after a short time.

Depending on the dicarboxylic acid used, the di-lithium dicarboxylate or di-metal dicarboxylate formed may be poorly soluble in water and in such a case may precipitate as a finely distributed salt.

In the next step, the monohydroxycarboxylic acid is added in substance, preferably as a solid, in dry form and the mixture is heated to for example 85° C. As a result, the dicarboxylic acid soap dissolves in the molten hydroxycarboxylic acid. The mixture between hydroxycarboxylic acid and dicarboxylic acid or the respective reaction products required to form the complex soap is already formed here. The mixture is then taken up in the necessary amount of base oil (e.g. 45 wt. % of the base oil in the finished lubricating grease), heated to e.g. 90° C. and then mixed with the other metal hydroxide such as lithium hydroxide, in particular in powder form, to saponify the hydroxycarboxylic acid. After a certain reaction time, the mixture is first heated to e.g. 100° C. to start dewatering, which is then completed at e.g. 105° C. after further base oil has been added (e.g. 30% of the base oil in the finished lubricating grease).

The complex soap formation was started in the aqueous medium by this reaction control and transferred to an oleophilic base oil after the complex soap structure was safely formed. After dewatering, the remaining amount of base oil can be added, the reaction mixture is heated to a final temperature of greater than 120° C. or greater than 160° C., preferably greater than 180° C., e.g. to 190 to 210° C., then cooled and suitable additives are added during the cooling phase to finalise the lubricating grease.

A mixed calcium-lithium complex soap-lubricating grease can also be produced using the method described. Optionally, the complexing dicarboxylic acid can be reacted with lithium hydroxide or calcium hydroxide. Accordingly, the hydroxycarboxylic acid is reacted with the other hydroxide. A significant advantage of the mixed lithium-calcium complex soap lubricating greases is the lower raw material and process costs. The calcium-lithium complex soap lubricating greases are preferably available from a ratio of lithium hydroxide to calcium hydroxide of 1:9 to 9:1 (weight ratio).

A further advantage of the lithium complex soap lubricating greases or calcium-lithium complex soap lubricating greases produced in this way is the preferential possibility of molar reaction of the metal hydroxides with the dicarboxylic and monohydroxycarboxylic acids. This makes it possible to obtain lubricating greases without unreacted lithium hydroxide components. Since June 2020, it has been under review whether lithium hydroxide should be classified as reprotoxic category 1A—H360 FD in the future (CoRAP list). According to the state of the art, lubricating greases with lithium soap thickeners are often produced with an excess of lithium hydroxide, as the poor water solubility of lithium hydroxide means that an excess is needed to ensure complete conversion of the carboxylic acids used.

DETAILED DESCRIPTION OF THE INVENTION

Standard lubricating oils that are liquid at room temperature are suitable as base oils. The base oil preferably has a kinematic viscosity of 20 to 2500 $mm^2/s$, in particular of 40 to 500 $mm^2/s$, in each case at 40° C. In the present case, the term base oil also includes a mixture of different base oils.

The base oils can be classified as mineral oils or synthetic oils. For example, naphthene-based mineral oils and paraffin-based mineral oils are considered mineral oils according to API Group I classification. Chemically modified mineral oils low in aromatics and sulphur with a low proportion of saturated compounds and improved viscosity/temperature behaviour compared to Group I oils, classified according to API Group II and III, are also suitable.

Synthetic oils include polyethers, esters, polyalphaolefins, polyglycols and alkylaromatics and mixtures thereof, as well as silicone oils. The polyether compound may have free hydroxyl groups, but may also be completely etherified or the end groups may be esterified and/or be produced from a starting compound with one or more hydroxyl and/or carboxyl groups (—COOH). Polyphenyl ethers, possibly alkylated, are also possible as the sole components or, even better, as mixed components. Suitable components are esters of an aromatic di-, tri- or tetracarboxylic acid with one or a mixture of C2 to C22 alcohols, esters of adipic acid, sebacic acid, trimethylolpropane, neopentyl glycol, pentaerythritol or dipentaerythritol with aliphatic branched or unbranched, saturated or unsaturated C2- to C22-carboxylic acids, C18-dimeric acid esters with C2- to C22-alcohols, complex esters, as individual components or in any mixture.

Lithium complex soaps are thickeners based on metal soaps, which are obtained by reacting a dicarboxylic acid with lithium hydroxide and a hydroxycarboxylic acid with lithium hydroxide. If, as an alternative to pure lithium complex soap, a mixed thickener of lithium and calcium complex soap is desired, a) the dicarboxylic acid is reacted with lithium hydroxide and a hydroxycarboxylic acid with calcium hydroxide or b) the dicarboxylic acid is reacted with calcium hydroxide and the hydroxycarboxylic acid with lithium hydroxide.

Aliphatic dicarboxylic acids with chain lengths from C6 to C12 such as adipic acid (C6), azelaic acid (C8) and sebacic acid (C10) can be used as dicarboxylic acids. Aromatic dicarboxylic acids such as terephthalic acid can also be used. The latter combinations, which are rather unusual for lithium complex fats, were previously only possible via the diversions of separate saponification of corresponding terephthalic acid esters in advance, whereby the alcohol is preferably removed from the equilibrium.

The reaction in an aqueous medium according to the invention makes such a thickener system more easily accessible.

C12 to C30 hydroxycarboxylic acids or mixtures thereof can be used as hydroxycarboxylic acids, whereby hydroxycarboxylic acids with 16 to 20 carbon atoms are generally preferred. In particular, hydroxystearic acid is used, for example, as 9-hydroxy, 10-hydroxy or 12-hydroxy stearic acid. Ricinoleic acid can also be used as an unsaturated, linear omega-9 fatty acid. However, 12-hydroxy behenic acid (C22) or 10-hydroxy palmitic acid can also be used as hydroxy fatty acids. Dihydroxystearic acids such as 9,10-dihydroxy stearic acid can also be used as hydroxy fatty acids. The hydroxycarboxylic acids are mono-carboxylic acids.

The ratio of hydroxycarboxylic acid to dicarboxylic acid is usually adjusted in molar ratios of 1:1 to 10:1. This is done depending on the desired properties of the fat.

In addition, the lubricating grease compositions according to the invention contain conventional additives against corrosion, oxidation and for protection against metal influences, which act as chelating compounds, radical scavengers, reaction layer formers and the like. Additives that improve the hydrolysis resistance of ester base oils, such as carbodiimides or epoxides, can also be added.

Common additives within the meaning of the invention are antioxidants, anti-wear agents, anti-corrosion agents, detergents, colourants, lubricity improvers, adhesion improvers, viscosity additives, friction reducers, high-pressure additives and metal deactivators. Examples include:

- primary antioxidants such as amine compounds (e.g. alkylamines or 1-phenylaminonaphthalene), aromatic amines such as phenylnaphthylamines or diphenylamines or polymeric hydroxyquinolines (e.g. TMQ), phenol compounds (e.g. 2,6-di-tert-butyl-4-methylphenol), zinc dithiocarbamate or zinc dithiophosphate;
- secondary antioxidants such as phosphites, e.g. tris(2,4-di-tert-butylphenylphosphite) or bis(2,4-di-tert-butylphenyl)-pentaerythritol diphosphite or thioethers (e.g. cresol thioethers);
- high-pressure additives and/or anti-wear additives such as sulphur or organic sulphur compounds such as polysulphides or sulphurised olefins, overbased calcium sulphonates, thiophosphates, phosphorus compounds such as e.g.
- amine-neutralised alkyl phosphates, inorganic or organic boron compounds, zinc dialkyl dithiophosphate, organic bismuth compounds; thiophosphonates such as triphenyl thiophosphate, phosphonates (phosphites) such as dioctyl phosphonate, alkyl sulphonates, thiocarbamates such as methylene bis(dibutyldithiocarbamates) and dithiocarbamates;

active ingredients that improve the "oiliness", such as C2 to C6 polyols, fatty acids, fatty acid esters or animal or vegetable oils;

anti-corrosion agents such as sulphonates, e.g. petroleum sulphonate, dinonyl naphthalene sulphonate or sorbitan ester; neutral or overbased calcium sulphonates, magnesium sulphonates, sodium sulphonates, calcium and sodium naphthalene sulphonates, sulphonic acid esters, disodium sebacate, calcium salicylates, amine phosphates, succinates;

metal deactivators such as benzotriazoles, e.g. methylbenzotriazole dialkylamine, sterically hindered phenols, sodium nitrite;

Viscosity improvers such as polymethacrylate, polyisobutylene, oligo Dec-1-ene, polystyrenes;

friction-reducing agents partly with anti-wear properties such as organomolybdenum complexes (OMC), molybdenum di-alkyl dithiophosphates, molybdenum di-alkyl dithiocarbamates, in particular molybdenum di-n-butyldithiocarbamate and molybdenum di-alkyl dithiocarbamate (Mo2mSn(dialkylcarbamate)2 with m=0 to 3 and n=4 to 1), zinc dithiocarbamate or zinc dithiophosphate; or a trinuclear molybdenum compound corresponding to the formula $MO_3S_kL_nQ_z$ wherein L are independently selected ligands having organo groups with carbon atoms as disclosed in U.S. Pat. No. 6,172,013 B1, to render the compound soluble or dispersible in the oil, wherein n ranges from 1 to 4, k ranges from 4 to 7, Q is selected from the group of neutral electron donor compounds consisting of amines, alcohols, phosphines and ethers, and e.g. ranges from 0 to 5 and comprises non-stoichiometric values (see DE 102007048091 A1);

organic acids such as isostearic acid, functional polymers such as oleylamides, organic compounds based on polyethers and amides, e.g. oleylamides, organic compounds based on polyethers and amides, e.g. alkyl polyethylene glycol tetradecylene glycol ether, PIBSI or PIBSA, partial glycerides, dialkyl hydrogen phosphonates, alkyl succinates.

Solid lubricants can be, for example, polymer powders such as polyamides, polyimides or PTFE, melamine cyanurate, graphite, metal oxides, boron nitride, silicates, e.g. magnesium silicate hydrate (talcum), sodium tetraborate, potassium tetraborate, metal sulphides such as molybdenum disulphide, tungsten disulphide or mixed sulphides based on tungsten, molybdenum, bismuth, tin and zinc, inorganic salts, for example of alkali and alkaline earth metals, such as calcium carbonate, sodium and calcium phosphates, as well as carbon black or other carbon-based solid lubricants such as nanotubes.

Lignin derivatives, such as alkali or alkaline earth lignin sulphonates, in particular calcium lignin sulphonates, can also be used to achieve specific properties (according to WO 2011095155 A1 or U.S. Pat. No. 8,507,421 B2). The lignin derivatives and the solid lubricants are not additives.

The lithium complex soap lubricating greases preferably comprise:

a) 55 to 95 wt. %, in particular 70 to 90 wt. %, of the base oil;

b) 5 to 25 wt. %, in particular 5 to 20 wt. %, of the lithium complex soap as thickener and optionally the following optional components:

c) 0 to 40 wt. %, in particular 0.5 to 10 wt. %, of additives;

d) 0 to 20 wt. %, in particular 0 to 5 wt. %, of inorganic thickeners, such as bentonite or amorphous $SiO_2$ or silicic acid; and e) 0 to 20 wt. %, in particular 0.1 to 15 wt. %, of solid lubricants;

f) 0 to 5 wt. %, in particular 0.1 to 5 wt. % of lignin derivatives.

As an alternative to pure lithium complex soap lubricating grease, the lithium-calcium complex soap lubricating greases contain:

a) 55 to 95 wt. %, in particular 70 to 90 wt. %, of the base oil;

b) 5 to 25 wt. %, in particular 5 to 20 wt. %, of the lithium-calcium complex soap as thickener, the ratio of lithium and calcium content being freely selectable within a ratio of 90:10 to 10:90, preferably 80:20 to 20:80, based on the metal hydroxides (LiOH and $Ca(OH)_2$), and, if applicable, the following optional components:

c) 0 to 40 wt. %, in particular 0.5 to 10 wt. %, of additives;

d) 0 to 20 wt. %, in particular 0 to 5 wt. %, of inorganic thickeners, such as bentonite or amorphous $SiO_2$ or silicic acid; and e) 0 to 20 wt. %, in particular 0.1 to 15 wt. %, of solid lubricants;

f) 0 to 5 wt. %, in particular 0.1 to 5 wt. % of lignin derivatives.

Preferably no inorganic thickeners are used.

The wt. percentages refer to the total composition and apply independently of each other. The wt. % figures add up to 100 wt. % for each selection of components, including any optional components not mentioned above.

In particular, the thickener or soap is used as thickener in such a way that the composition contains enough thickener to obtain a cone penetration value (worked penetration) of 220 to 430 mm/10 (at 25° C.), preferably 265 to 385 mm/10 (at 25° C.) (determined according to DIN ISO 2137).

The process is carried out so that the thickener in the lithium complex soap lubricating grease or in the lithium-calcium complex soap lubricating grease is produced by in-situ reaction of the above-mentioned hydroxycarboxylic acids and dicarboxylic acids with lithium hydroxide or lithium and calcium hydroxide, the saponification reaction of the dicarboxylic acid being carried out in an aqueous environment. The salt thus formed is then taken up by a molten hydroxy fatty acid or a hydroxy fatty acid that is liquid in substance, followed by conversion into an oily phase. The hydroxy fatty acid is then saponified by adding dry lithium hydroxide or calcium hydroxide in the stoichiometrically required quantity. The water is then expelled as the temperature progresses and the reaction mixture is heated to a defined final temperature. After a defined cooling phase, conventional additives, solids or other base oil components can be added at temperatures of, for example, 60° to 80° C.

According to the process underlying the present invention for the production of the lithium complex grease-soap lubricating greases or the lithium-calcium complex grease-soap lubricating greases, a preliminary stage (base grease) is first produced by combining at least the dicarboxylic acid and water with lithium hydroxide or calcium hydroxide at preferably 20° to 85° C., in particular 40° to 70° C., adding the hydroxycarboxylic acid at preferably above 60° C. or above 75° C., in particular between greater than 80 and 90° C., a first partial quantity of the base oil and lithium hydroxide or calcium hydroxide at preferably greater than 70° C. or greater than 80° C., in particular at 90 to 100° C., boiling the water at preferably at least 100° C., in particular above 100° C. or above 105° C. (expulsion temperature), addition of a further partial quantity of base oil and heating to a defined final temperature greater than 120° C., preferably at least 130° C. or preferably at least 150° C., e.g. 190 to 210° C., cooling the base grease and adding further oils, additives, solid lubricants substances or another thickener component.

Preferably, the lithium complex base fat is heated to temperatures of over 180° C., in particular at least 190° C., to produce the lithium complex base fat. The conversion to the base fat takes place in a heated reactor, which can also be designed as an autoclave or vacuum reactor.

Subsequently, in a second step, the formation of the thickener structure is completed by cooling and, if necessary, further components such as additives and/or base oil are added to adjust the desired consistency or the desired property profile. The second step can be carried out in the reactor of the first step, but preferably the base fat is transferred from the reactor to a separate stirred vessel for cooling and mixing in any further ingredients.

According to one embodiment, for example, lithium-calcium complex soap lubricating greases are produced by using a calcium 12-hydroxystearate as the base thickener, which is complexed with the aid of lithium sebacate. In the production of these base greases, temperatures between 130° and 160° C., preferably 150° C., are required as the final temperature.

The lubricating greases according to the invention are particularly suitable for use in or for slide bearings and rolling bearings in a wide range of industrial applications. Lithium complex greases are all-round greases with an increased temperature application range. The use of calcium-lithium complex soap can have a positive effect on raw material costs, as a smaller amount of lithium can be used.

The lithium complex soap lubricating greases or lithium-calcium complex soap lubricating greases produced by the process according to the invention preferably have a high dropping point of over 260° C. for the lithium complex soap lubricating greases and of over 190° C. for the lithium-calcium complex soap lubricating greases.

In the following examples, the characteristics of the lithium complex greases according to the invention are compared with those produced using a conventional route. Conventional production is described here for example 4 and can be transferred to the other examples by analogy.

COMPARATIVE EXAMPLE 718.1 g of polyalphaolefin PAO 40 was placed in a heatable reaction vessel with a stirrer and 186 g of 12-hydroxystearic acid and 49.4 g of sebacic acid were added while stirring. This mixture is heated to 85° C. in the reaction vessel with stirring and kept at this temperature for 30 minutes. A mixture of 46.5 grams of lithium hydroxide monohydrate, which was slurried in 150 grams of hot water, is then added. The mixture is kept in the reaction vessel at 85° C. for 30 minutes with stirring. The temperature is then increased to 100° C. The reaction mixture was then heated to 105° C. to expel the water. After this step, 500 g of polyalphaolefin PAO 40, which had previously been heated to 100° C. in a separate vessel, was added, followed by boiling the mixture to a final temperature of 205° C. The fat was then cooled to 60° C. and homogenised using a colloid mill.

Example 1: Preparation of a Lithium Complex Soap Lubricating Grease with Azelaic Acid 39.0 g azelaic acid and 160 g water were provided in a heatable reaction vessel with a stirrer. The mixture was heated to 60° C. and 18.2 g of lithium hydroxide was added in powder form.

After a reaction time of 30 minutes, 186.0 g of 12-hydroxystearic acid was added and the mixture was heated to 85° C. This is followed by the addition of 550 g polyalphaolefin PAO 40. The mixture is stirred to a homogeneous mass and 26.9 g lithium hydroxide in powder form is added, followed by a 30-minute reaction time.

The mixture was then heated to 100° C. and a further 380 g of polyalphaolefin PAO 40 was added. The reaction mixture was then heated to 105° C. to expel any remaining water. After this step, 300 g of polyalphaolefin PAO 40 was added, followed by boiling the mixture to a final temperature of 205° C. The fat was then cooled to 60° C. and homogenised using a colloid mill.

Table 1 summarises the characteristics of the fat according to the invention in comparison with a fat produced by a conventional route, namely according to the comparison example above (comparison).

TABLE 1

| Measured value | Method | Comparison | Invention |
|---|---|---|---|
| RP-immediately [0.1 mm] | DIN ISO 2137 | 232 | 213 |
| RP-24 h [0.1 mm] | DIN ISO 2137 | 209 | 200 |
| Δ(RP-immediately − RP-24 h) | | 23 | 13 |
| WP60 [0.1 mm] | DIN ISO 2137 | 250 | 220 |
| WP60000 [0.1 mm] | DIN ISO 2137 | 280 | 268 |
| Δ(WP60 − WP60.000) | | 30 | 48 |
| Dropping point [° C.] | DIN ISO 2176 | 291° C. | 297° C. |
| OS 100° C./18 h [wt. %] | DIN 51817 | 0.9% | 1.0% |

RP = static penetration,
OS = oil separation

The advantage of the lithium complex soap lubricating grease produced by the process according to the invention lies, among other things, in the improved thickener yield: the worked penetration WP60 shows a significantly firmer grease.

Example 2: Production of a Lithium Complex Soap Lubricating Grease with Terephthalic Acid 35.0 g of terephthalic acid and 150 g of water were placed in a heatable reaction vessel with a stirrer. The mixture was heated to 60° C. and 17.7 g of lithium hydroxide in powder form was added. After 30 minutes of reaction time, 190.1 g of 12-hydroxystearic acid was added and the mixture was heated to 85° C. This was followed by the addition of 550 g polyalphaolefin PAO 40.

The mixture is stirred to a homogeneous mass and 26.6 g of lithium hydroxide in powder form is added, followed by a 30-minute reaction time. The mixture was then heated to 100° C. and a further 380 g of polyalphaolefin PAO 40 was added. The reaction mixture was then heated to 105° C. to expel any remaining water.

After this step, 300.8 g of polyalphaolefin PAO 40 was added, followed by boiling the mixture to a final temperature of 205° C. The fat was then cooled to 60° C. and homogenised using a colloid mill.

The following table summarises the characteristic values of the lubricating grease. As no conversion with terephthalic acid is possible using the conventional boiling process, no comparative data can be given here.

TABLE 2

| Measured value | Method | Invention |
|---|---|---|
| RP-immediately [0.1 mm] | DIN ISO 2137 | 243 |
| RP-24 h [0.1 mm] | DIN ISO 2137 | 233 |
| Δ(RP-immediately − RP-24 h) | | 10 |
| WP60 [0.1 mm] | DIN ISO 2137 | 271 |
| WP60000 [0.1 mm] | DIN ISO 2137 | 261 |
| Δ(WP60 − WP60.000) | | 10 |
| Dropping point [° C.] | DIN ISO 2176 | >300 |
| OS 100° C./18 h [wt. %] | DIN 51817 | 4.3 |

Example 3: Production of a Lithium Complex Soap Lubricating Grease with Sebacic Acid and Ester Oil 26.5 g of sebacic acid and 160 g of water were provided in a heatable reaction vessel with a stirrer. The mixture was heated to 60° C. and 11.5 g of lithium hydroxide was added in powder form. After 30 minutes of reaction time, 123.5 g of 12-hydroxystearic acid was added and the mixture was heated to 85° C. This is followed by the addition of 594.4 g of a polyol ester (viscosity 320 $mm^2/s$ at 40° C.). The mixture is stirred to a homogeneous mass and 17.8 g of lithium hydroxide in powder form is added, followed by a 30-minute reaction time.

The mixture was then heated to 100° C. and a further 396.2 g of the polyol ester was added. The reaction mixture was then heated to 105° C. to expel any remaining water. After this step, 330.2 g of polyol ester was added, followed by boiling the mixture to a final temperature of 205° C. The fat was then cooled to 60° C. and homogenised using a colloid mill.

Table 3 compares the characteristics of this fat with a fat produced using a conventional route according to the above example.

TABLE 3

| Measured value | Method | Comparison | Invention |
|---|---|---|---|
| RP-immediately [0.1 mm] | DIN ISO 2137 | 278 | 273 |
| RP-24 h [0.1 mm] | DIN ISO 2137 | 251 | 238 |
| Δ(RP-immediately − RP-24 h) | | 27 | 35 |
| WP60 [0.1 mm] | DIN ISO 2137 | 297 | 277 |
| WP60000 [0.1 mm] | DIN ISO 2137 | 321 | 304 |
| Δ(WP60 − WP60.000) | | 24 | 27 |
| Dropping point [° C.] | DIN ISO 2176 | 290° C. | 280° C. |
| OS 100° C./18 h [wt. %] | DIN 51817 | 5.2% | 4.0% |
| Odour | like fatty alcohol | distinct | inconspicuous |

The advantage of the lithium complex fat via the new process is that the ester used is not (partially) hydrolysed. In the conventional process, the formation of fatty alcohols can be detected in the odour. In addition, the new process route leads to an improved thickener yield.

Example 4: Production of a Lithium Complex Soap Lubricating Grease with Sebacic Acid in Polyalphaolefin 49.4 g of sebacic acid and 150 g of water were provided in a heatable reaction vessel with a stirrer. The mixture was heated to 60° C. while stirring.

20.5 g of dry lithium hydroxide in powder form was added to the mixture and stirred for 30 minutes at a constant temperature. Then 186.0 g of 12-hydroxystearic acid was added and the mixture was heated to 85° C. while stirring. This was followed by the addition of 550 g polyalphaolefin 40, which had previously been preheated to 100° C. After mixing, 26.0 g of dry lithium hydroxide was added in powder form. This was followed by a 30-minute reaction time with stirring. The reaction mixture was heated to 100° C., followed by the addition of 365 g polyalphaolefin 40 (preheated to 100° C.). The mixture was then heated to 105° C. for dewatering. After reaching 105° C., 303.1 g of polyalphaolefin 40 was added and the mixture was heated to a final temperature of 205° C. over the course of 2.5 hours. The fat was then cooled to 60° C. and homogenised using a colloid mill.

Table 4 summarises the characteristics of this fat in comparison with a fat produced using a conventional route according to the above comparative example

TABLE 4

| Measured value | Method | Comparison | Invention |
|---|---|---|---|
| RP-immediately [0.1 mm] | DIN ISO 2137 | 226 | 221 |
| RP-24 h [0.1 mm] | DIN ISO 2137 | 197 | 207 |
| Δ(RP-immediately − RP-24 h) | | 29 | 14 |
| WP60 [0.1 mm] | DIN ISO 2137 | 241 | 233 |
| WP60000 [0.1 mm] | DIN ISO 2137 | 305 | 258 |
| Δ(WP60 − WP60.000) | | 64 | 25 |
| Dropping point [° C.] | DIN ISO 2176 | 291° C. | 290° C. |
| OS 100° C./18 h [wt. %] | DIN 51817 | 0.6% | 1.4% |

The advantage of the lithium complex grease via the new process lies on the one hand in the significantly higher mechanical stability (lower Δ WP60/WP60,000) and on the other hand in the lower post-hardening at rest.

In summary, with regard to the properties of the lithium complex greases produced according to the invention, it can be said that the new manufacturing process:

- leads to an improved thickener yield, which means that lubricating greases of the same consistency can be produced more cheaply,
- depending on the base oil used, the thickener has improved worked stability,
- lithium complex greases with a terephthalate thickener content can be produced for the first time,
- lithium complex fats can be produced with less hydrolytically stable ester oils,
- in addition, the process according to the invention can be carried out more quickly and offers increased work safety, as the base does not have to be prepared and added separately.

The following two examples describe the production of mixed lithium-calcium complex soap lubricating greases and calcium-lithium complex soap lubricating greases.

Example 5: Production of a Lithium-Calcium Complex Soap Lubricating Grease with Sebacic Acid 38.6 g sebacic acid, 14.1 g calcium hydroxide and 150 g water were placed in a heatable reaction vessel with a stirrer. The mixture was heated to 90° C. while stirring. Then 180.0 g of 12-hydroxystearic acid was added and mixed for 30 minutes until a dough-like mass was formed. To the reaction mixture, 500 g of polyalphaolefin 8 (preheated to 100° C.) was added with stirring and mixed for 30 minutes. Then 25.2 g of dry lithium hydroxide in powder form was added to this mixture and the reaction mixture was stirred for 30 minutes at the same temperature. The reaction mixture was then heated to 100° C., followed by the addition of 300 g of preheated polyalphaolefin 8. The mixture was then heated to 105° C., during which time dewatering of the batch took place. After reaching 105° C., 442.2 g of polyalphaolefin 8 was added and the batch was heated to a final temperature of 205° C. over the course of 2.5 hours. The grease was then cooled to 60° C. and homogenised using a colloid mill.

The following table summarises the characteristics of the lithium-calcium complex fat.

TABLE 5

| Measured value | Method | Conventional process | New process |
|---|---|---|---|
| RP-immediately [0.1 mm] | DIN ISO 2137 | 289 | 295 |
| RP-24 h [0.1 mm] | DIN ISO 2137 | 249 | 276 |
| Δ(RP-immediately − RP-24 h) | | 40 | 19 |
| WP60 [0.1 mm] | DIN ISO 2137 | 307 | 306 |
| WP60000 [0.1 mm] | DIN ISO 2137 | 349 | 344 |
| Δ(WP60 − WP60.000) | | 42 | 38 |
| Dropping point [° C.] | DIN ISO 2176 | 257 | 263 |
| OS 100° C./18 h [wt. %] | DIN 51817 | 10 | 6.8 |
| Water resistance | | | |
| 40° C. [BWST] | DIN 51807-1 | 0 | 0 |
| 90° C. [BWST] | | 0 | 0 |

Due to the formation of the lithium-calcium complex soap lubricating grease, the dropping point is at a high level. Compared to the conventional process (started in base oil), the process according to the invention provides a lubricating grease with increased consistency stability and reduced oil separation. The water resistance is also at a high level at 90° C. hot water with resistance level 0 (BWST 0). The effect of the calcium soap content has a positive effect here.

Compared to a pure lithium complex grease, 30-40% lithium hydroxide can be saved, which has a favourable effect on the cost price.

Example 6: Production of a Calcium-Lithium Complex Soap Lubricating Grease with Sebacic Acid In a heatable reaction vessel with a stirrer, 26.0 g of sebacic acid was placed in 150 g of water and heated to 60° C. While stirring, 11.3 g of lithium hydroxide in powder form was added and the mixture was stirred for 30 minutes to ensure a complete reaction. The mixture was heated to 85° C. with stirring, 121.5 g of 12-hydroxystearic acid was added and stirred until a homogeneous mixture was formed.

To this was added 600 g of a 1:1 mixture consisting of a Group I oil (SN600) and a naphthenic base oil (T110) and homogenised with stirring. Subsequently, 15.0 g of calcium hydroxide in powder form was added and the mixture was stirred for 30 minutes at 85° C. to ensure complete saponification. The reaction mixture was then heated to 100° C., followed by the addition of 400 g of the base oil described above, which was preheated to 100° C. The brew was then heated to 105° C. and the batch was dehydrated. A further 326.2 grams of the preheated base oil was then added. After the batch had been dehydrated, the final temperature of 150° C. was increased. After the batch had cooled down to 60° C., it was homogenised using the colloid mill.

TABLE 6

| Measured value | Method | Conventional process | New process |
|---|---|---|---|
| RP-immediately [0.1 mm] | DIN ISO 2137 | 308 | 294 |
| RP-24 h [0.1 mm] | DIN ISO 2137 | 291 | 289 |
| Δ(RP-immediately − RP-24 h) | | 17 | 5 |
| WP60 [0.1 mm] | DIN ISO 2137 | 311 | 304 |
| WP60000 [0.1 mm] | DIN ISO 2137 | 348 | 328 |
| Δ(WP60 − WP60.000) | | 37 | 24 |
| Dropping point [° C.] | DIN ISO 2176 | 200 | 196 |
| OS 40° C./18 h [wt. %] | DIN 51817 | 1.2 | 2.0 |
| OS 100° C./18 h [wt. %] | DIN 51817 | 7.0 | 7.9 |
| Water resistance | | | |
| 40° C. [BWST] | DIN 51807-1 | 0 | 0 |
| 90° C. [BWST] | DIN 51807-1 | 1 | 1 |

Due to the formation of the calcium-lithium complex soap, the dropping point is below the level of the lithium-calcium complex grease from example 5. Compared to the conventional route, the new process route produces lubricating greases with better mechanical stability and a slightly improved thickener yield. The calcium-lithium complex soap lubricating grease is economically very attractive:

The base grease described in example 6 can be seen as an economical alternative to lithium 12-hydroxistearate greases. In addition, the manufacturing process is more favourable in terms of energy, as a comparatively low process temperature of 150° C. is used compared to the usual >200° C.

In summary, it can be said that the manufacturing process according to the invention can also be used to produce lithium-calcium complex soap lubricating greases which are above all very attractive economically, have excellent water resistance and good consistency stability.

The invention claimed is:

1. A method for producing lithium complex soap lubricating greases or lithium-calcium complex soap lubricating greases comprising at least the following steps:

saponification of one or more dicarboxylic acids with one or two metal hydroxides, the one or two metal hydroxides being solids, according to one of the following three alternatives:

(A1) saponification of the one or more dicarboxylic acids with lithium hydroxide, or (A2) saponification of the one or more dicarboxylic acids with lithium hydroxide and calcium hydroxide and one or more dicarboxylic acids, or (A3) saponification of the one or more dicarboxylic acids with calcium hydroxide, each in an aqueous environment comprising, more than 90 wt. % of water, calculated based on all liquid feedstocks used, further comprising heating to at least 40° C. to obtain one or more metal salts of the dicarboxylic acids, wherein both dicarboxyl groups of the dicarboxylic acids are substantially completely saponified;

bringing the metal salt(s) into contact with one or more liquid hydroxycarboxylic acids or hydroxycarboxylic acids liquefied by heating and dissolving the metal salt(s) in the liquid or liquefied hydroxycarboxylic acids;

adding base oil and applying heating before and/or after adding base oil;

thereafter charging further metal hydroxides, wherein for alternative (A1) the further metal hydroxide is lithium hydroxide or calcium hydroxide; for alternative (A2) the further metal hydroxide is lithium hydroxide and calcium hydroxide or lithium hydroxide only or calcium hydroxide only; or for alternative (A3) the further metal hydroxide is lithium hydroxide; for saponification with the at least one hydroxycarboxylic acid;

removal of water under heating;

heating to a final temperature; and cooling down and addition of additional base oil.

2. The method according to claim 1, wherein the saponification of the one or more dicarboxylic acids in the aqueous environment takes place at 40° to 85° C.

3. The method according to claim 1, wherein the hydroxycarboxylic acid is liquefied by heating.

4. The method according to claim 1, wherein the saponification with the one or more hydroxycarboxylic acids takes place at a temperature above 80° C.

5. The method according to claim 1, wherein the removal of water is at greater than 105° C.

6. The method according claim 1, wherein the final temperature is between 190 to 210° C.

7. The method according to claim 1, wherein, after reaching the final temperature, cooling is carried out and it is added below 120° C. one or more of: further base oil, additives, solid lubricants and a further thickener component.

8. The method according to claim 1, wherein the base oil has a kinematic viscosity of from 20 to 2500 mm2/s at 40° C.

9. The method according to claim 1, wherein the one or more dicarboxylic acids are aliphatic dicarboxylic acids having 6 to 12 carbon atoms or cyclo-aliphatic or aromatic dicarboxylic acids having 8 to 12 carbon atoms.

10. The method according to claim 1, wherein the one or more hydroxycarboxylic acids comprise 12 to 30 carbon atoms.

11. The method according to claim 1, wherein the hydroxycarboxylic acid and the dicarboxylic acid are used in a molar ratio of 1:1 to 10:1.

12. The method according claim 1, wherein the metal hydroxides are used in bulk or in powder form.

13. The method according to claim 1, wherein the lithium complex soap lubricating greases comprise:

a) 55 to 95 wt. % of the base oil;

b) 5 to 25 wt. % of the lithium complex soap;

and optionally one or more of the following components:

c) 0 to 40 wt. % of additives;

d) 0 to 20 wt. % of inorganic thickeners; and e) 0 to 20 wt. % of solid lubricants.

14. The method according to claim 1, wherein the lithium-calcium complex soap lubricating greases comprise:

a) 55 to 95 wt. % of the base oil;

b) 5 to 25 wt. % of the lithium-calcium complex soap, wherein the weight ratio in relation to the lithium hydroxide to calcium hydroxide used is 1:9 to 9:1, and optionally one or more of the following components:

c) 0 to 40 wt. % of additives;

d) 0 to 20 wt. % of inorganic thickeners; and e) 0 to 20 wt. % of solid lubricants.

15. A Lithium complex soap lubricating grease or lithium-calcium complex soap lubricating grease produced by the method according to claim 1.

16. The Lithium complex soap lubricating grease or lithium-calcium complex soap lubricating grease according to claim 15, having a dropping point of above 260° C. for the lithium complex soap lubricating grease and a dropping point of above 190° C. for the lithium-calcium complex soap lubricating grease.

17. A slide bearing or rolling bearing comprising a lubricant point with the lithium complex soap lubricating grease or lithium-calcium complex soap lubricating grease according to claim 15.

18. The method according to claim 1, wherein the method comprises alternative (A1) only.

19. The method according to claim 1, wherein the hydroxycarboxylic acid is liquefied by heating.

* * * * *